United States Patent [19]

Napier

[11] Patent Number: 4,781,578

[45] Date of Patent: Nov. 1, 1988

[54] PILOT BURNER APPARATUS

[75] Inventor: Samuel O. Napier, Sapulpa, Okla.

[73] Assignee: John Zink Company, Tulsa, Okla.

[21] Appl. No.: 756,916

[22] Filed: Jul. 18, 1985

Related U.S. Application Data

[63] Continuation of Ser. No. 573,499, Jan. 24, 1984, abandoned.

[51] Int. Cl.[4] ..... F23D 14/12

[52] U.S. Cl. ..... 431/347

[58] Field of Search ..... 431/347, 354, 355; 60/39.828

[56] References Cited

U.S. PATENT DOCUMENTS

| | | | |
|---|---|---|---|
| 571,076 | 11/1896 | Seigle . | |
| 790,365 | 5/1905 | Harvey . | |
| 951,394 | 3/1910 | Hauck . | |
| 1,198,006 | 9/1916 | Chance | 431/347 |
| 1,280,214 | 10/1918 | Hansen . | |
| 1,296,506 | 3/1919 | Hansen . | |
| 1,474,641 | 11/1923 | Powers . | |
| 1,818,471 | 8/1931 | Geaugue . | |
| 2,073,448 | 3/1937 | Fruth et al. . | |
| 2,148,797 | 2/1939 | Barna | 431/347 |
| 2,368,179 | 1/1945 | Turpin | 431/347 |
| 2,585,221 | 2/1952 | Briskin . | |
| 2,646,113 | 7/1953 | Tavener . | |
| 2,828,814 | 4/1958 | Larkin | 431/347 |
| 2,855,770 | 10/1958 | Grube . | |
| 3,002,553 | 10/1961 | Reed . | |
| 3,363,663 | 1/1968 | Porter . | |
| 3,544,255 | 9/1968 | Roper | 431/347 |
| 3,802,829 | 4/1974 | Morris | 431/347 |
| 3,825,189 | 7/1974 | Ohsawa | 431/347 |
| 3,925,001 | 12/1975 | Salooja | 431/347 |

*Primary Examiner*—Randall L. Green

*Attorney, Agent, or Firm*—Laney, Dougherty, Hessin & Beavers

[57] ABSTRACT

Pilot burner apparatus is provided which has improved flame stability and other characteristics. The pilot burner is comprised of a hollow body member having a combustible gas inlet nozzle portion at one end connected to a sleeve portion which forms an outlet at the other end. A heat retaining member is disposed within the sleeve portion adjacent the outlet end thereof. Upon short duration combustion disturbances, flame stability is maintained by the burner.

5 Claims, 2 Drawing Sheets

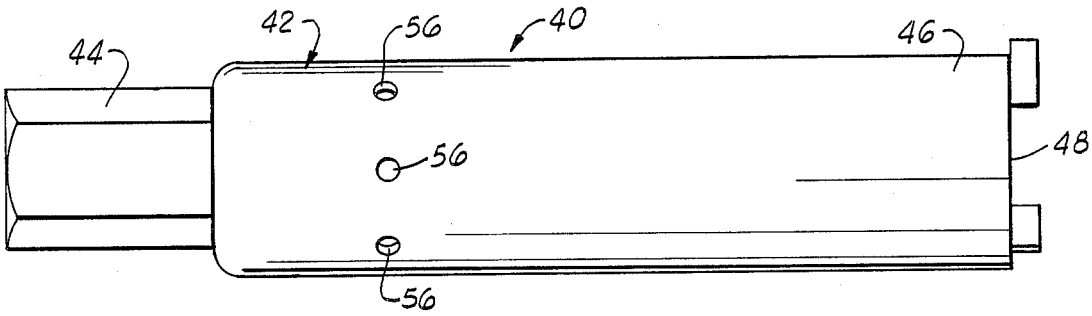
FIG. 7
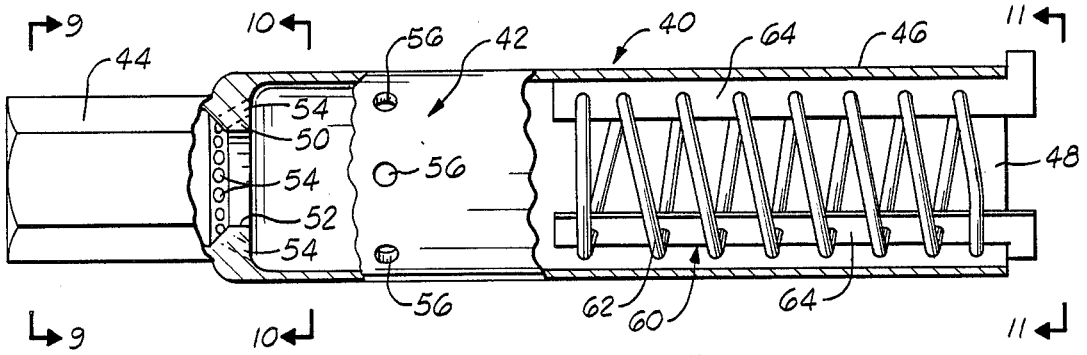
FIG. 8
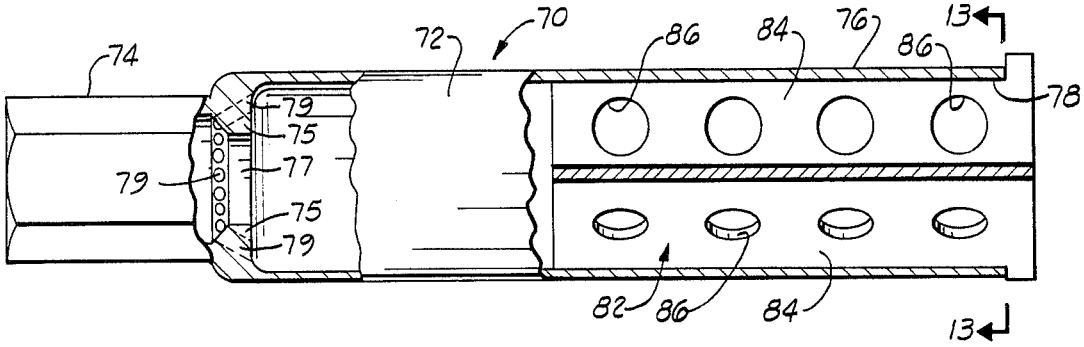
FIG. 12
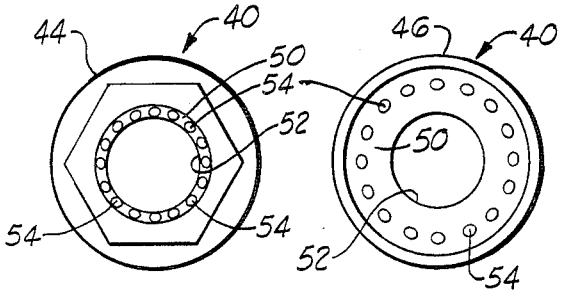
FIG. 9
FIG. 10
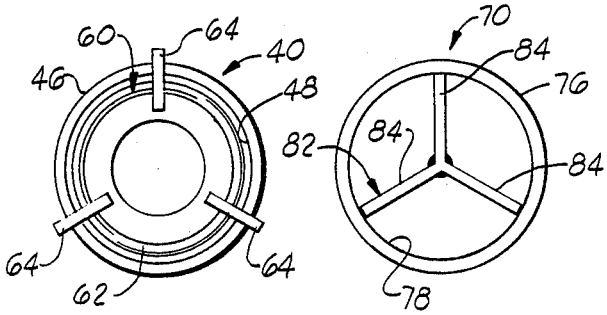
FIG. 11
FIG. 13

PILOT BURNER APPARATUS

This is a continuation of application Ser. No. 573,499, filed Jan. 24, 1984, now abandoned.

BACKGROUND OF THE INVENTION

1. Field of the Invention

The present invention relates generally to pilot burner apparatus, and more particularly, but not by way of limitation, to pilot burner apparatus of the type used to ignite combustible materials emitted from one or more other burners in flares, heaters and other similar apparatus.

2. Description of the Prior Art

A great variety of pilot burner designs and apparatus have been developed and used over the years. Generally, a pilot burner functions to provide a continuous pilot flame adjacent one or more main burners for igniting combustible materials periodically emitted from the main burners. Examples of applications of pilot burners in association with main burners are domestic and industrial heaters, boilers, dryers, etc. In addition, a variety of emergency and/or waste disposal flare apparatus for burning combustible materials are utilized in industry which include pilot burners.

In the above mentioned and other applications for pilot burners, it is desirable that the pilot burners have maximum flame stability in a variety of environmental conditions, i.e., that the burners be capable of maintaining a pilot flame in various forms and quantities of draft, at varying inlet combustible gas pressures, when exposed to draft or winds from various directions and other similar conditions. In addition, it is desirable that a pilot burner have the ability to maintain flame stability upon short duration combustion disturbances. The term "combustion disturbance" is used herein to mean any of a number of circumstances causing flame instability and a possible flame outage such as a combustible gas flow interruption, the flame being blown away from the pilot by wind, snuffed by wind or a momentary increase in external pressure, pulled away from the burner by momentary decreases in external pressure, etc.

By the present invention, pilot burner apparatus is provided having improved operational stability and other characteristics including the ability to maintain flame stability during and after short-term combustion disturbances.

SUMMARY OF THE INVENTION

The present invention provides a pilot burner comprised of a hollow body member having a combustible gas inlet nozzle portion at one end connected to a sleeve portion which forms an outlet at the other end. A heat retaining member is disposed within the sleeve portion of the body member adjacent the outlet end thereof whereby during the combustion of a combustible gas at the burner, the heat retaining member is heated and upon short duration combustion disturbances, flame stability is maintained by the burner.

It is, therefore, a general object of the present invention to provide a pilot burner apparatus.

A further object of the present invention is the provision of pilot burner apparatus having improved flame stability and other characteristics.

Another object of the present invention is the provision of pilot burner apparatus having the ability to re-ignite combustible gas flowing therethrough after short duration combustion disturbances.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 7 is a side view of an alternate form of the pilot burner of the present invention.

FIG. 8 is a partially sectional side view of the pilot burner of FIG. 7.

FIG. 9 is a cross-sectional view taken along line 9—9 of FIG. 8.

FIG. 10 is a cross-sectional view taken along line 10—10 of FIG. 8.

FIG. 11 is an end view taken along line 11—11 of FIG. 8.

FIG. 12 is a partially sectional side view of yet another form of the pilot burner of the present invention.

FIG. 13 is a cross-sectional view taken along line 13—13 of FIG. 12.

DESCRIPTION OF PREFERRED EMBODIMENTS

Figure 1:
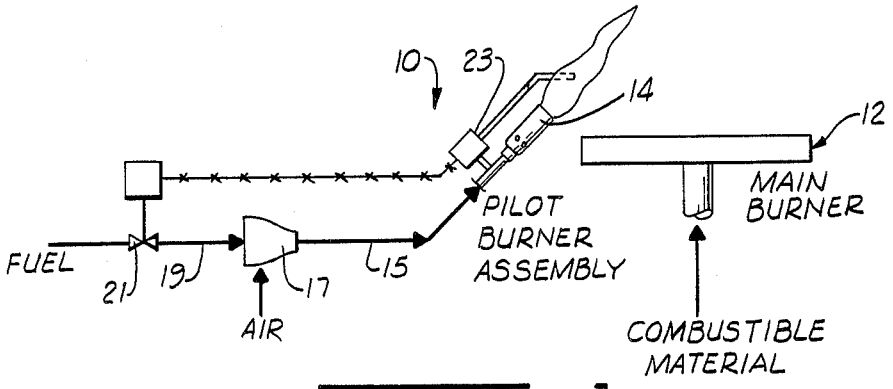
FIG. 1 is a schematic illustration of a typical pilot burner assembly associated with a main burner.
Figure 2:
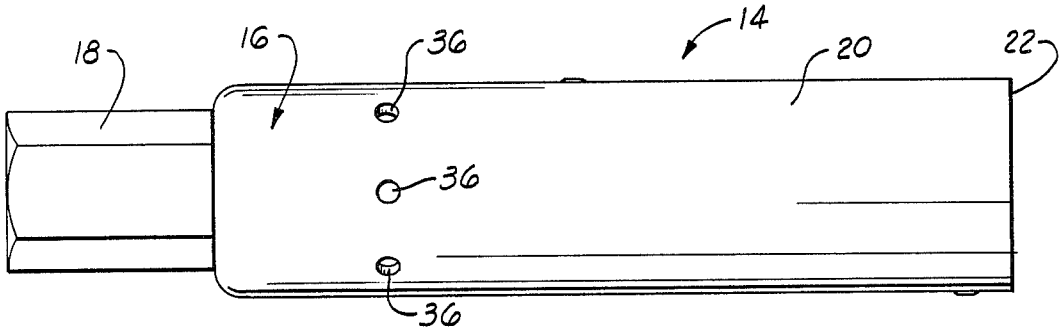
FIG. 2 is a side view of the pilot burner of the present invention.

Referring now to the drawings, and particularly to FIG. 1, a typical pilot burner assembly, generally designated by the numeral 10, and a main burner 12 are illustrated schematically. The pilot burner assembly 10 is positioned with respect to the main burner 12 such that a pilot flame is continuously maintained in a position whereby upon the emission of combustible materials from the main burner 12, the ignition thereof is effected by the pilot burner flame.

The pilot burner assembly 10 is comprised of a pilot burner of the present invention 14 which is positioned adjacent the main burner 12. The pilot burner 14 is connected by a conduit 15 to a conventional fuel-air mixer apparatus 17. While various fuel-air mixer apparatus have been developed, the most commonly used are of the Venturi type which inspirate air into the fuel as a result of fuel flow through the mixer. A conduit 19 connects the fuel-air mixer 17 to a source of pressurized fuel. When desired, the assembly 10 also includes a shut-off valve 21 disposed in the conduit 19 which is maintained in the open position only so long as a flame exists at the pilot burner 14 as determined by a conventional flame sensing device 23 operably connected to the valve 21.

In operation of the pilot burner assembly 10, a constant flow of pressurized fuel from a source thereof passes through the shut-off valve 21 and the conduit 19 into and through the fuel-air mixer 17. While flowing through the fuel-air mixer 17, air is inspirated into the fuel stream and mixed therewith and the resulting fuel-air mixture flows by way of the conduit 15 through the pilot burner 14 where it is combusted. As a result of the combustion, a pilot flame is produced at the pilot burner 14 adjacent the main burner 12.

The flame sensing device 23 maintains the shut-off valve 21 in the open position only so long as a pilot flame exists at the burner 14. In the event combustion is terminated and the flame is extinguished, the flame sensing device 23 shuts off the flow of fuel and air to the pilot burner by causing the shut-off valve 21 to close. In addition, the control signal from the flame sensing device 23 can be used to actuate a main burner combustible material shut-off. As long as the pilot burner assembly 10 produces a flame at the pilot burner 14, combustible material such as a fuel or a combustible waste emitted from the main burner 12 is ignited by the pilot flame and combusted.

The pilot burner 14, flame sensing device 23 and main burner or burners 12 may be disposed within a heater or other similar structure wherein the draft (intake of atmospheric air) is induced naturally or wherein one or more blowers are used for inducing the draft (forced draft). In a flare application, the pilot burner assembly 10 and one or more main burners 12 can be disposed within an enclosure such as in a stack or they can be disposed in the open, either at ground level or at an elevated level.

Referring now to FIGS. 2–6, a presently preferred form of the pilot burner 14 is illustrated. The pilot burner 14 is comprised of a hollow body member 16 having a combustible gas inlet nozzle portion 18 at one end connected to a sleeve portion 20 which forms an outlet 22 at the other end. The combustible gas inlet nozzle portion 18 of the body member 16 can take various forms, but in a preferred form the portion 18 includes a centrally disposed threaded bore 24 and a hexagonal shaped exterior whereby it can be conveniently threaded to a conduit. The nozzle portion 18 also includes an internal wall 26 which forms a central discharge orifice 28 positioned within and concentrically to the sleeve portion 20 of the body member 16. In the form of the pilot burner illustrated in FIGS. 2–6, with respect to the longitudinal axis of the body member 16, the wall 26 extends radially inwardly a short distance, then longitudinally towards the discharge end 22 of the member 16 a short distance and then radially inwardly again whereby a cylindrical nozzle, generally designated by the numeral 25, is formed interiorly of the sleeve portion 20. The nozzle 25 and the interior of the sleeve portion 20 form an annular space 27 therebetween.

Figure 3:
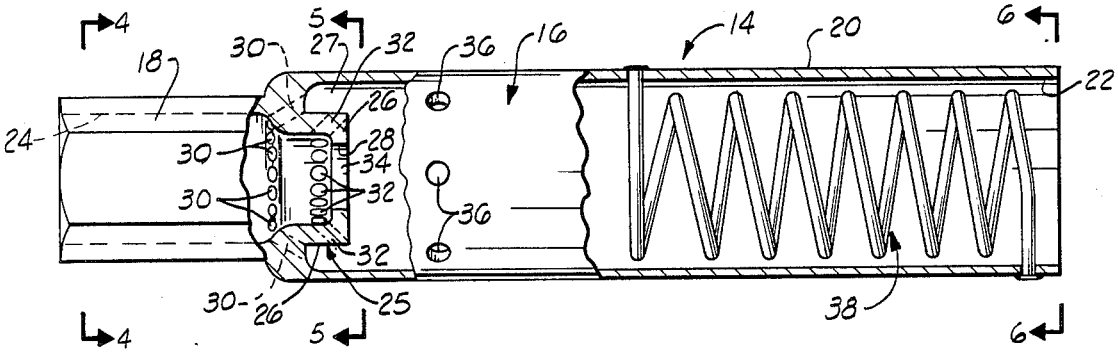
FIG. 3 is a partially sectional side view of the pilot burner of FIG. 2.
Figure 4:
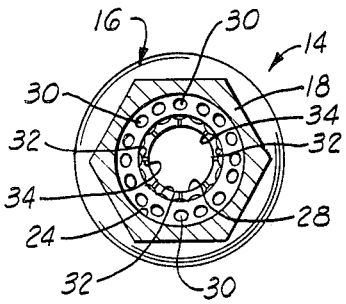
FIG. 4 is a cross-sectional view taken along line 4—4 of FIG. 3.
Figure 5:
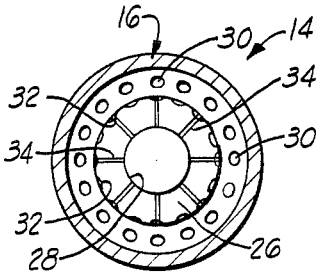
FIG. 5 is a cross-sectional view taken along line 5—5 of FIG. 3.
Figure 6:
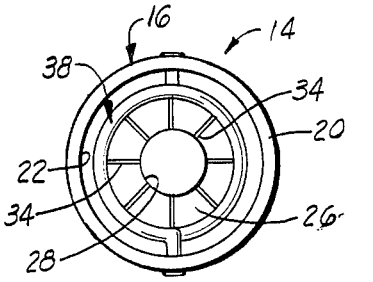
FIG. 6 is a cross-sectional view taken along line 6—6 of FIG. 3.

A first plurality of spaced apart discharge apertures 30 are disposed in the first radially inwardly extending portion of the nozzle 25. The apertures 30 extend from the interior of the nozzle 25 to the annulus 27. A second plurality of spaced apart discharge apertures 32 are disposed in the longitudinal portion of the wall 26 and extend from the interior thereof to the annulus 27. As best shown in FIGS. 3 and 4, the apertures 30 and 32 are positioned around the interior of the nozzle 25 in spaced relationship to each other. In addition, the axes of the apertures 30 and 32 converge. Finally, a plurality of spaced apart slots 34 are formed in the second radially inwardly extending portion of the wall 26. The slots 34 extend from the centrally disposed discharge orifice 28 radially outwardly to the discharge apertures 32.

The sleeve portion 20 of the body member 16 includes a plurality of spaced apart ports 36 positioned around the sleeve portion 20 in a plane perpendicular to the longitudinal axis thereof.

Positioned within the sleeve portion 20 and terminating adjacent the outlet 22 thereof is a heat retaining member 38. In the form illustrated in FIGS. 3 and 6, the heat retaining member 38 is a helical coil formed of an elongated metallic material, the ends of which are rigidly attached, such as by welding, to the sides of the sleeve 20. In this form, the heat retaining member 38 is preferably a heat resistant metal alloy capable of withstanding prolonged heating such as an alloy of nickel and chromium. However, other suitable metals or ceramic materials can also be used.

Operation of the Pilot Burner 14

In operation of the pilot burner 14, a fuel-air mixture enters the interior of the nozzle portion 18 from a conduit threadedly connected thereto. The fuel-air mixture is driven by pressure differential through the discharge apertures 30 and 32, the discharge slots 34 and the discharge orifice 28, all in the nozzle 25. The portion of the fuel-air mixture flowing through the discharge orifice 28 forms a jet which flows longitudinally through the sleeve portion 20 and out of the sleeve portion 20 by way of the outlet 22 as the fuel-air mixture burns. The fuel-air mixture flowing through the discharge apertures 30 and 32 form jets which collide with each other and with the interior wall of the sleeve portion 20 within the annulus 27 as the fuel-air mixture begins to burn. The collisions bring about a reduction in the velocity of the jets and improve the stability of the flame produced by the pilot burner 14. The discharge slots 34 act to transfer the burning to the main jet produced by the discharge orifice 28. Also, portions of the fuel-air mixture adjacent the internal walls of the sleeve portion 20 may flow through the ports 36 therein and be combusted outside the sleeve portion 20. The ports 36 act to help equalize pressure between the interior of the sleeve 20 and the external environmental surrounding the sleeve 20.

As indicated above, the fuel-air mixture flowing through the body member 16 of the pilot burner 14 is partially combusted within the sleeve portion 20 and partially combusted outside the sleeve portion 20 whereby an elongated flame extends from within the sleeve portion 20 a distance beyond the outlet 22 thereof. The combustion that takes place within the sleeve portion 20 of the pilot burner 14 continuously heats the member 38 disposed therein. In the event of short duration combustion disturbances, the heat retaining member 38 remains hot and re-ignites or otherwise stabilizes the flame produced from the fuel-air mixture.

Referring now to FIGS. 7–11, an alternate form of the pilot burner of the present invention is illustrated and generally designated by the numeral 40. The structure and operation of the pilot burner 40 is similar to the structure and operation of the pilot burner 14 except that the heat retaining member of the pilot burner 40 is removable. Also, the pilot burner 40 is illustrated with an alternate nozzle discharge orifice and aperture arrangement. More specifically, the pilot burner 40 includes a hollow body member 42 having a combustible gas inlet nozzle portion 44 at one end connected to a sleeve portion 46 which forms an outlet 48 at the other end. The nozzle portion 44 of the body member 42 can, and in most cases preferably does, include a radially inwardly extending internal wall forming an internal nozzle with a central discharge orifice and two sets of discharge apertures identical to the nozzle 25 of the pilot burner 14 described above. However, for purposes of this disclosure, the nozzle portion 44 of the pilot burner 40 is illustrated with an optional nozzle arrangement which can be utilized in applications where the operating environment and/or requirements for the pilot burner are different.

The nozzle portion 44 of the pilot burner 40 includes a radially inwardly extending wall 50 which forms a central discharge orifice 52. A single plurality of spaced apart discharge apertures 54 is provided, the apertures being spaced around the interior of the wall 50 and extending therethrough.

The sleeve portion 46 of the body member 42 includes a plurality of ports 56 formed therein, which function in the same manner as the ports 36 described above, and positioned within the sleeve portion 46 is a removable heat retaining member 60. The heat retaining member 60 is similar to the heat retaining member 38 described above in connection with the pilot burner 14 in that it includes a helical coil 62 formed of heat resistant metal such as a metal alloy. However, instead of being directly attached to the sleeve portion 46 of the body member 42, the coil 62 is attached to three elongated spacing members 64 which are in turn slidably disposed within the interior of the sleeve portion 46. Enlarged portions are provided on the members 64 to prevent the heat retaining member 60 from being moved inwardly within the sleeve portion 46 too far and for facilitating the removal thereof.

Referring now to FIGS. 12 and 13, yet another form of the pilot burner of the present invention is illustrated and generally designated by the numeral 70. The pilot burner 70 is similar in structure and operation to the pilot burners 14 and 40 described above. More specifically, the pilot burner 70 is comprised of a hollow body member 72 having a combustible gas inlet nozzle portion 74 at one end connected to a sleeve portion 76 which forms an outlet 78 at the other end. The inlet nozzle portion 74 is illustrated in the same arrangement as the pilot burner 40, i.e., it includes a radially inwardly extending internal wall 75 which forms a central discharge orifice 77 and has discharge apertures 79 formed therein. The sleeve portion 76 of the body member 72 includes a heat retaining member 82 which is removable disposed within the sleeve portion 76. However, instead of a helical coil formed of elongated heat resistant material, the heat retaining member 82 is of an alternate design which includes three elongated longitudinally positioned heat resistant heat retaining plates 84 formed of a suitable material. The plates 84 are connected together at the inner sides thereof and the outer sides are in slidable contact with the interior of the sleeve portion 76 so that the member 82 is removable. Each of the plates 84 forming the heat retaining member 82 can include a plurality of openings 86 formed therein for promoting mixing, etc.

As will be understood by those skilled in the art, the heat retaining member utilized with the pilot burner of the present invention can take various forms other than those which are presently preferred and specifically disclosed herein. Further, the heat retaining member can be formed from a variety of materials with those having the properties of long life and high heat retention being preferred.

The pilot burner of the present invention has improved flame stability properties over a variety of conditions including over a broad range of fuel gas pressures, under back pressures, over a broad range of draft conditions, both natural and forced, and under various air supply and wind conditions including those at directions transverse to the axis of the pilot burner. For example, while the times vary with a variety of factors, under simulated low natural draft conditions (0.08 inches of water column) and a fuel pressure of 15 psig, a pilot burner of the present invention (as illustrated in FIGS. 2–6) with a heat retaining member 38 formed of a heat resistant alloy of nickel and chromium re-ignites the fuel mixture after fuel mixture flow interruptions of up to six seconds. Under simulated forced draft conditions of 0.2 inches water column positive pressure and 15 psig fuel pressure, re-ignition is achieved after a fuel mixture flow interruption of four seconds. Under a positive pressure of 0.7 inches water column, the maximum time the fuel mixture flow can be interrupted with re-ignition taking place is two seconds with full heat retaining member reheating between interruptions. Under 0.7 inches water column positive pressure and only a four second reheat time, the maximum pilot burner fuel mixture flow interruption time is one second.

Thus, the present invention is well adapted to carry out the objects and attain the ends and advantages mentioned as well as those inherent therein. While presently preferred embodiments of the invention have been described herein for purposes of disclosure, numerous changes in the construction and arrangement of parts can be made by those skilled in the art, which changes are encompassed within the spirit of this invention as defined by the appended claims.

What is claimed is:

1. A pilot burner comprising:

a hollow body member having a combustible gas inlet nozzle portion at one end connected to a sleeve portion which forms an outlet at the other end;

said nozzle portion of said body member including an internal wall which extends radially inwardly a short distance, then longitudinally towards the discharge end of said body member a short distance and then radially inwardly again whereby a cylindrical nozzle is formed interiorly of said sleeve portion having a central discharge orifice therein and forming an annular space between the interior of said sleeve portion and said cylindrical nozzle, said internal wall including first and second pluralities of spaced apart discharge apertures disposed therein positioned around said central discharge orifice, extending from the interior of said cylindrical nozzle to said annular space and having axes, respectively, which coverage and intersect the interior of said sleeve portion; and a heat retaining member disposed within said sleeve portion of said body member adjacent the outlet end thereof whereby during the combustion of a combustible gas at said burner said heat retaining member is heated and upon short duration combustion disturbances, flame stability is maintained by said burner.

2. The pilot burner of claim 1 wherein said heat retaining member is at least partially formed in the shape of a helical coil.

3. The pilot burner of claim 2 wherein said sleeve portion of said body member includes at least one combustible gas discharge port formed in a side thereof.

4. The pilot burner of claim 3 wherein said nozzle portion of said body member further includes a plurality of spaced slots disposed through said internal wall and extending radially outwardly from said central discharge orifice to said second plurality of discharge apertures therein.

5. The pilot burner of claim 4 wherein said heat retaining member is removable disposed within said sleeve portion of said body member.

* * * * *